US005990782A

United States Patent [19]

Lee

[11] Patent Number: 5,990,782

[45] Date of Patent: Nov. 23, 1999

[54] ELECTRONIC PILLBOX FOR ADMINISTERING A MULTIPLE-DRUG THERAPY

[75] Inventor: Simon Lee, Causeway Bay, The Hong Kong Special Administrative Region of the People's Republic of China

[73] Assignee: Hago Limited, Kwun Tong Kln., The Hong Kong Special Administrative Region of the People's Republic of China

[21] Appl. No.: 09/085,852

[22] Filed: May 27, 1998

[51] Int. Cl.[6] ..... G08B 1/00

[52] U.S. Cl. ..... 340/309.15; 340/309.4; 340/573; 368/10; 368/109

[58] Field of Search ..... 340/309.15, 573, 340/309.4; 368/10, 105, 109, 107, 110, 111, 112, 113; 206/534, 538

[56] References Cited

U.S. PATENT DOCUMENTS

| | | | |
|---|---|---|---|
| 3,818,473 | 6/1974 | Murray et al. | 368/10 |
| 4,419,016 | 12/1983 | Zoltan | 368/10 |
| 4,490,711 | 12/1984 | Johnston | 340/309.4 |
| 4,626,105 | 12/1986 | Miller | 206/538 |
| 4,660,991 | 4/1987 | Simon | 368/10 |
| 4,768,176 | 8/1988 | Kehr et al. | 368/10 |
| 4,768,177 | 8/1988 | Kehra et al. | 368/10 |
| 4,793,492 | 12/1988 | Halbich | 368/10 |
| 5,020,037 | 5/1991 | Raven | 340/309.15 |
| 5,159,581 | 10/1992 | Agans | 368/10 |
| 5,233,571 | 8/1993 | Wirtschafter | 368/10 |
| 5,246,136 | 9/1993 | Lidl | 221/3 |
| 5,289,157 | 2/1994 | Rudick et al. | 340/309.15 |

OTHER PUBLICATIONS

Photocopy of packaging for an Electronic Pill Box Timer/Clock, Model 885, American Medical Industries.

*Primary Examiner*—Edward Lefkowitz
*Assistant Examiner*—Davetta Woods
*Attorney, Agent, or Firm*—Jones, Day, Reavis & Pogue

[57] ABSTRACT

An electronic pillbox includes a plurality of compartments for storing different medications, an LCD-based user interface for interacting with a user, and a software-programmable electronic computer for controlling the administration functions of the pillbox. The pillbox may also include a battery and one or more types of alarms. Using the user interface, a user can schedule a multiple drug therapy by inputting sleeping pattern data and a dosage amount for a particular compartment. The computer automatically calculates the dosage schedule based on this information, and automatically recalculates the schedule if this information is altered by the user. A visual indicator on the user interface is illuminated when a particular medication is to be taken, and at the same time an audible and/or mechanical alarm may be activated. The combination of the visual and audible or mechanical alarms ensures that the correct medication is administered according to the programmed schedule.

25 Claims, 11 Drawing Sheets

ELECTRONIC PILLBOX FOR ADMINISTERING A MULTIPLE-DRUG THERAPY

BACKGROUND OF THE INVENTION

The present invention is directed toward the field of portable electronic pillboxes. In particular, a compact, portable electronic pillbox is disclosed that includes special-purpose electronic circuitry and software that enables the user (i.e. patient) of the pillbox to schedule a multiple-drug therapy and also to automatically re-schedule the therapy by changing input data regarding the user's sleeping pattern.

The portable electronic pillbox disclosed herein includes a plurality of compartments for holding different medications. At the center of the pillbox is an electronic computer that allows a user to program the daily dosage of each pill (or medication) for each compartment. The user can also program the start and end times for actuating an alarm feature, wherein the start and end times are based on the user's sleep pattern. Having programmed the dosage for each compartment, and the start and end times of the user's day (i.e. the sleep pattern), the electronic computer can automatically calculate the times that the user should take a particular medication and can then notify the user when those times occur via an alarm, which can include a visual, audible and/or mechanical indicator. The electronic computer also provides numerous other features and functions, as described in more detail below, such as (i) the ability to inform the user of the next dosage time and the next dosage medications so that the user can always obtain precise information concerning the medication schedule; and (ii) the ability to automatically re-calculate the medication schedule when the user changes their sleeping pattern by responding to a change in the user-input start and end times, to name a few.

Today there are many ailments that require patients to take a multiple-drug therapy, such as high blood pressure, heart disease, kidney disease, AIDS, etc. In addition, it is very common for elderly persons to take multiple drugs for a variety of therapeutic reasons. These multiple drug therapies require that a plurality of different drugs are taken during the day, often in different dosage levels and at different times. For example, the dosage of one drug may be twice per day, while the dosage of another drug may be three times a day, etc., depending upon how many drugs are part of the multiple-drug therapy. Thus it can be very difficult for the patient, particularly if the patient is elderly, to remember when and what dosage to take for each of the plurality of medications. Non-compliance with the drug therapy as prescribed can pose serious health consequences for the patient, in the extreme case it could even cause loss of life. It is important, therefore, that patients who are taking a multiple-drug therapy are able to precisely administer their medications according to a prescribed schedule.

Presently there are known pillboxes (some electronic) that have been designed to assist patients with organizing their medications. Some of these include a plurality of compartments that are arranged, indexed and differentiated in units for use over a selected period of time. Many of these pillboxes do not have any kind of timing device to remind patients to take their medications so they do not enable patients to precisely administer their own medications. Some of these pillboxes do include electronic timers that remind the patient when to take a particular medication at a fixed time interval. However, these designs are generally not portable, and do not provide the features and functions that are necessary to intelligently administer, schedule, reschedule and provide information to the user regarding a multiple-drug therapy.

One presently known electronic pillbox is manufactured by American Medical Industries. This pillbox includes only two compartments, and also includes a timer device. Each of the two compartments can be programmed with a count-down timer. The user sets the timer to a particular time interval, and then starts the count-down by pressing a button. When the countdown timer reaches zero, an alarm sounds. The user then takes a pill and presses another button to reset the count-down timer. This design suffers from many disadvantages that make it not particularly useful for administering a multiple-drug therapy, such as: (1) it only includes two compartments, and thus it is limited to a two-drug therapy; (2) there is no "one-to-one" correspondence between the alarm and the compartment, meaning that when the alarm sounds there is no indication of what pill to take—this could obviously have disastrous consequences for the patient; (3) the user must "reset" the timer each time the alarm goes off, so if the user forgets to press the reset button, the device will not remind the user to take their next dosage, again with potentially disastrous consequences for the patient; and (4) it does not provide the intelligence to schedule, reschedule and display pertinent information to the user regarding their therapy.

Another presently known electronic pillbox is set forth in U.S. Pat. No. 5,020,037 to Raven ("Raven"). The Raven pillbox includes a timer device. The user can set nine different alarm times, e.g., at 1:00 pm, 3:00 pm, 6:00 pm, etc. When the current time measured by an internal clock matches one of the alarm times, an alarm will sound. The alarm remains on until the user opens the lid of the container, and then the alarm will go off. Each time the user opens the lid, a visual indicator is displayed on an included LCD to indicate that the pillbox has been opened. By counting the visual indicators, the user knows how many times he has taken a particular pill. This design also suffers from many disadvantages that make it not useful for administering a multiple-drug therapy, such as: (1) it does not indicate which medication the user should take; (2) it does not provide a one-to-one correspondence between the nine different alarm times and a plurality of different compartments; (3) it requires the user to count the number of times a particular medication has been taken, which could be difficult for a mentally challenged individual; (4) it is not designed to provide multiple-pill indications, i.e., there is no way to indicate that a user needs to take more than one kind of medication at any specific time; and (4) it does not provide information to the user regarding the schedule of medications to take in the next dosage cycle.

Another presently known electronic medication organizer is set forth in U.S. Pat. No. 4,626,105 to Miller ("Miller"). The Miller organizer has four compartments, and each compartment has an associated timer device that can be programmed with dosage interval and start time. Using this information, the compartment timer calculates the next dosage time and displays it to the user. Like the previously discussed systems, this device also suffers from many disadvantages that make it not useful for administering a multiple-drug therapy, such as: (1) it is not a compact, portable design and therefore cannot be taken with a user who is traveling, at work, or otherwise not at home; (2) it requires a plurality of timers that must be individually set by the user; (3) its scheduling principle is based on a fixed time interval between each dosage, so that if a user changes their sleeping pattern a dosage could be missed; and (4) it is complex, large, and would be costly to manufacture, and thus not available to lower income users.

Therefore, there remains a general need in this field for a low cost, portable, electronic pillbox that is capable of administering a multiple-drug therapy.

There remains a more particular need for such an electronic pillbox that provides a one-to-one correspondence between a plurality of medication compartments and indicators that inform the patient of which medications should be taken.

There remains still an additional need for such an electronic pillbox that is capable of dynamically rescheduling dosage times and alarms based upon a change in the user's sleeping pattern.

There remains another need for such an electronic pillbox that includes computer software intelligence that enables the user to precisely administer, schedule, reschedule and obtain information regarding the multiple-drug therapy.

There remains still another need for such an electronic pillbox that can provide numerous alarm types, such as audible, visual, and/or mechanical alarms, and which provides a correspondence between these alarms and the medications to be administered.

SUMMARY OF THE INVENTION

The present invention overcomes the problems noted above and satisfies the needs in this field, including many others not explicitly listed, for a portable electronic pillbox for administering a multiple-drug therapy. The electronic pillbox includes a plurality of compartments for storing different medications, any LCD-based user interface for interacting with the user, and a software-programmable electronic computer for controlling the administration functions of the device. The pillbox may also include a battery and one or more types of alarms, such as an audible alarm like a buzzer, or a mechanical alarm like a vibrator.

The user interface includes an LCD for displaying information to the user, and a plurality of input buttons for controlling the functions of the device. The buttons are used to navigate the device through a plurality of different modes, described below, which enable the user to schedule a particular multiple-drug therapy, and to control the numerous features of the device. The LCD display includes a numeric timer display, a low-battery indicator, numerous navigational displays, and a plurality of visual indicators that correspond to the plurality of medication compartments.

Using the user interface, a patient can schedule a multiple drug therapy by inputting their sleeping pattern in the form of a start time and an end time, and by inputting a dosage amount for a particular compartment. The electronic computer then automatically calculates the dosage schedule based on this information. If the user subsequently changes their sleeping pattern, the device will automatically reschedule the medication alarms to accommodate this new pattern. When a particular medication is scheduled to be taken, a visual indicator is illuminated on the user interface. This visual indicator corresponds to the compartment where the scheduled medication is located. At the same time, an audible and/or mechanical alarm will sound to remind the user that they should take a pill. The combination of the visual and/or audible or mechanical alarms minimizes the risk that the patient will miss a particular medication.

The device described in this application provides many advantages that make it suitable for administering a multiple-drug therapy, such as: (1) it is compact and can fit into the pocket of the patient for easy transport; (2) it can easily schedule and reschedule the dosage of a multiple-drug therapy; (3) the dosage of each medication can be programmed individually; (4) its alarm system can indicate that more than one medication is to be taken at the same time; (5) it provides visual, audio, and/or mechanical alarm indications; (6) it enables the user to program a sleeping pattern based upon a start and end time, and then reprogram the sleeping pattern without worry about the dosage schedule; (7) it automatically calculates the medication schedule and recalculates based upon a change in sleep pattern; (8) it provides an efficient user interface for providing information to the user and enabling the user to control the administration functions of the device; and (9) it provides a low battery indicator to remind the user to change the battery.

These are just a few of the many advantages of the present invention, as described in more detail below. As will be appreciated, the invention is capable of other and different embodiments, and its several details are capable of modifications in various respects, all without departing from the spirit of the invention. Accordingly, the drawings and description of the preferred embodiments set forth below are to be regarded as illustrative in nature and not restrictive.

BRIEF DESCRIPTION OF THE DRAWINGS

The present invention satisfies the needs noted above as will become apparent from the following description when read in conjunction with the accompanying drawings wherein:

FIG. 5 is a flow chart of the main event loop from which other software modules and functions are called.

FIG. 6 is a flow chart of the module for determine whether the current time maintained by the pillbox is equivalent to the dosage time in any of the plurality of compartments, such that an alarm should be engaged.

FIG. 7 is a flow chart of the module for providing the functionality associated with the user pressing the "HR" button of the user interface.

FIG. 8 is a flow chart of the function for displaying dosage information to the user.

FIG. 9 is a flow chart of the function for incrementing the dosage counter.

FIG. 10 is a flow chart of the function for incrementing the start or end time.

FIG. 11 is a flow chart of the module for providing the functionality associated with the user pressing the "MODE" button of the user interface.

FIG. 12 is a flow chart of the module for providing the functionality associated with the user pressing the "MIN/SLOT" button of the user interface.

FIG. 13 is a flow chart of the function for adjusting the mask registers of all the compartments.

DETAILED DESCRIPTION OF THE DRAWINGS

Figure 1:
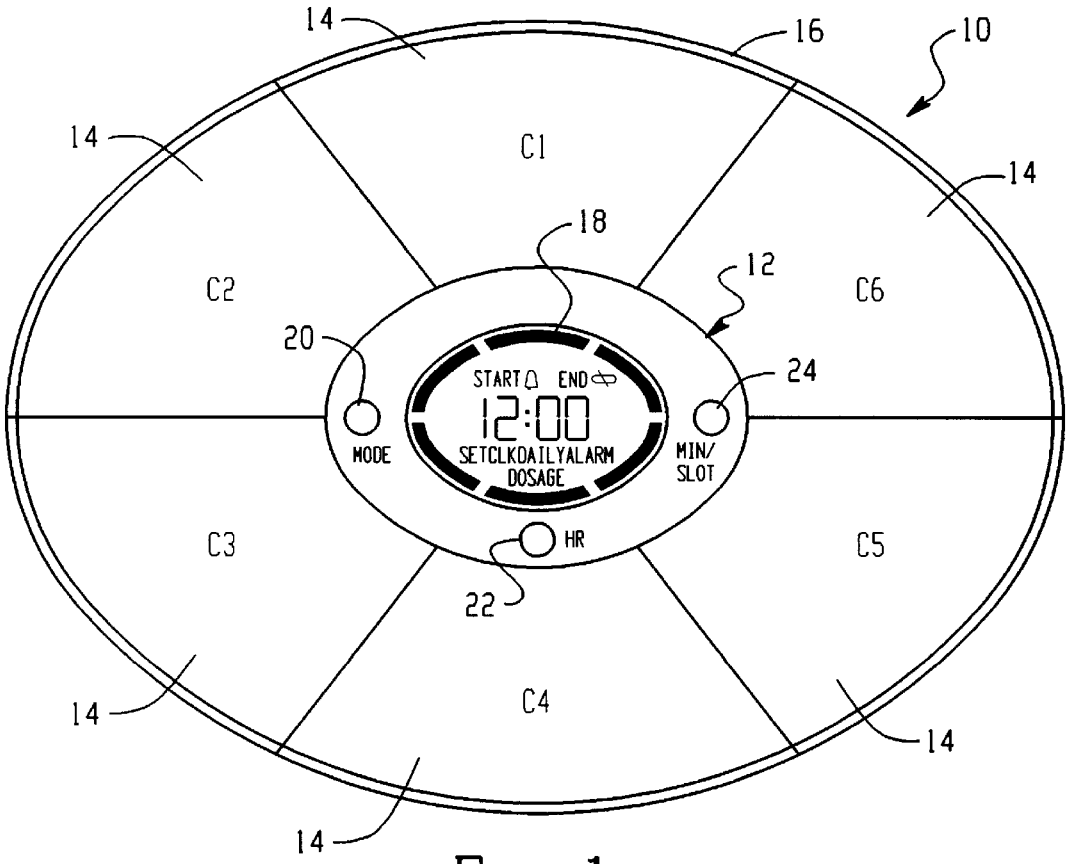
FIG. 1 is a top view of a preferred embodiment of an electronic pillbox according to the present invention.

Referring now to the drawings, FIG. 1 sets forth a top view of a preferred embodiment of the electronic pillbox 10 of the present invention. The pillbox 10 is preferably oval-shaped, but could, alternatively, be circular, square, or of some other geometry. In addition, the pillbox 10 is preferably made of transparent plastic (or other material) so that the user can see the pills in the various compartments 14. Of course, other materials could be used, and the pillbox does not necessarily need to be transparent. In one embodiment the entire pillbox could be made of a transparent material. In another embodiment only the lids 16 that cover the compartments 14 are transparent. In another embodiment there could be some type of transparent window in the lids 16 for viewing the medicines in the plurality of compartments 14.

The pillbox 10 includes a plurality of compartments (labeled C1–C6), each compartment for storing a particular medication, and including a lid 16 that covers the compartment storage area 14. In the preferred embodiment shown in FIG. 1, there is one lid 16 for each compartment 14. In other embodiments (not specifically shown), there could be a different number of compartments 14 and lids 16. FIG. 1 shows six compartments 14. Alternatively there could be any other number of compartments 14. The invention is not limited to any particular number of compartments.

The pillbox 10 also includes an electronic computer and a user interface 12, which is preferably located at the center of the pillbox, but which could, alternatively, be located in a different position with respect to the compartments 14. The computer/interface 12 includes a Liquid Crystal Display ("LCD") 18 for displaying information to the user, and a plurality of user input and control buttons 20, 22 and 24 for navigating through the user interface 12 and controlling the administrative functions programmed into the pillbox 10. Not shown explicitly in FIG. 1 is the electronic computer, which could be a microprocessor, microcontroller or other form of intelligent electronic control circuitry, such as an ASIC, FPGA, or discrete circuitry. This device is preferably mounted below the LCD 18 on a printed circuit board ("PCB") 30. The computer preferably includes software programming instructions that control the operation of the pillbox 10 as well as the user interface 12. These programming instructions, which are described below in connection with FIGS. 5–13, could be programmed directly into a microcontroller, or could be programmed into an external memory device, such as an EPROM, EEPROM, or Flash ROM that is also located on the PFCB.

Figure 2:
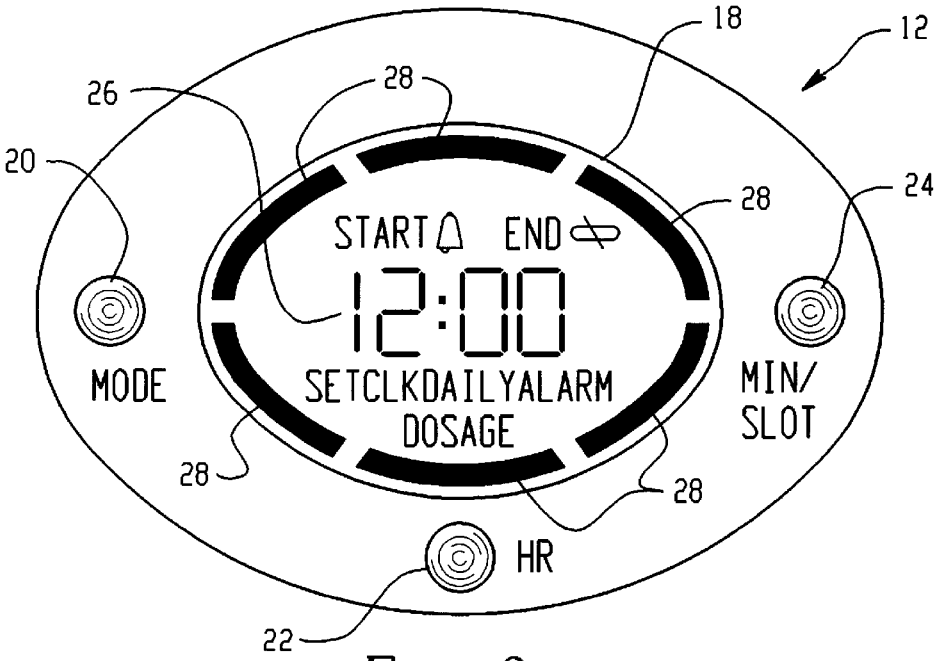
FIG. 2 is an expanded view of the user interface elements of the preferred electronic pillbox shown in FIG. 1.

FIG. 2 is an expanded view of the user interface module 12 of the electronic pillbox shown in FIG. 1. The user interface module 12 consists of the LCD 18, and a plurality of user interface buttons 20, 22 and 24. The visual elements of the user interface presented by the LCD 18 include a clock 26, a plurality of visual compartment indicators 28, a plurality of navigational messages that permit the user to program the device, an alarm indicator in the shape of a bell, and a low battery indicator. In the preferred pillbox of FIG. 1 there are six compartments and six visual indicators 28, one for each compartment. This provides a one-to-one correspondence between the visual alarm indicators 28 and the compartment that contains the medication to be taken. The navigational messages include "START", "END", "SETCLK", "DAILY DOSAGE", and "ALARM." These messages are used in connection with the three input buttons 20, 22, 24 to enable the user to program a particular schedule into the device. The three interface buttons are labeled "MODE", "HR", and "MIN/SLOT". The operation of these buttons is described in more detail below and in connection with Figures. 5–13.

Figure 3:
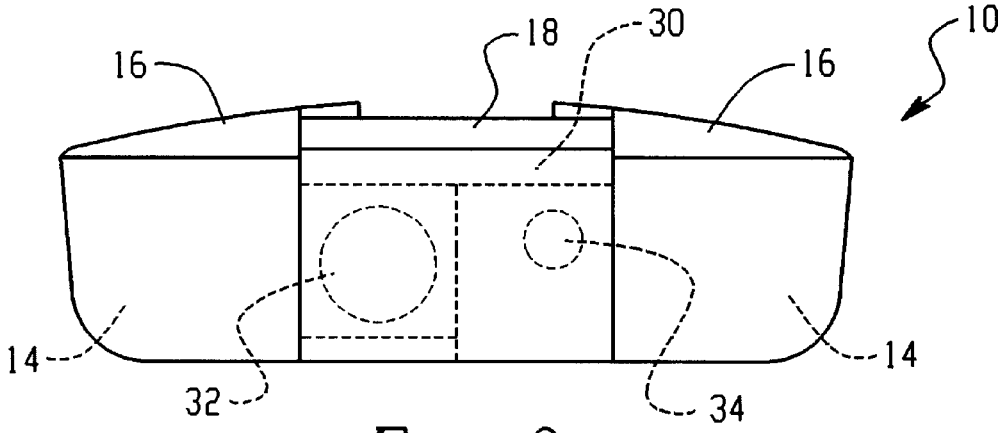
FIG. 3 is a side view along the minor axis of the preferred electronic pillbox.
Figure 4:
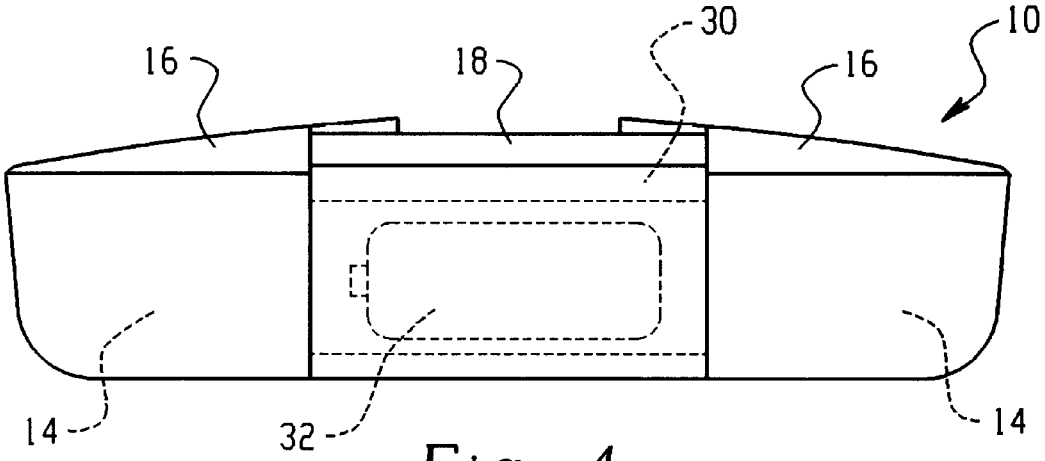
FIG. 4 is a side view along the major axis of the preferred electronic pillbox.

FIGS. 3 and 4 set forth, respectively, side views along the minor axis and the major axis of the preferred oval-shaped electronic pillbox 10 shown in FIGS. 1 and 2. These side views set forth the compartments 14 and associated lids 16, the LCD 18, a PCB 30 that includes the electronic computer for controlling the operation of the pillbox, a main battery 32, and a micro-motor 34. The micro-motor 34 could, alternatively, be an audible buzzer. In addition to the main battery 32, which provides power to the pillbox 10 under normal conditions, there could also be a backup battery (not shown explicitly) that provides limited power to the device for a short period of time when the main battery 32 is exhausted so that the user has time to get a new main battery installed.

Having described the elements of the electronic pillbox of the present invention, we now turn to the preferred modes of operation of the device. The device 10 preferably includes four modes of operation: Normal Mode, SetClk (Set Clock) Mode, Daily Dosage Mode, and Alarm Mode. Each of these modes is described below.

1. Normal Mode

In most situations the device 10 is in the Normal Mode of operation, i.e. when the user is not manipulating the user interface of the device. When the device 10 is in Normal Mode, the LCD 18 displays the current time in digital format on the clock 26. If the user presses the "HR" or "Hour" button in this mode, the LCD 18 will display the next time that the user is to take a pill(s), and will also display the compartment visual indicator(s) 28 for that pill. For example, if it is 10:00 am and the user is scheduled to take pills in compartments 1, 4, and 6 at 2:00 pm, by pressing the "HR" button the LCD 18 will display 2:00 pm on the clock 26 and will display the visual indicators for compartments 1, 4 and 6. In this manner, the user can review what medications are scheduled to be taken next.

Periodically, such as every hour, the device 10 will determine whether it is time to take a medication stored in a particular compartment 14. If the current time maintained by the device matches the scheduled time for any of the compartments, the alarm(s), including a visual alarm indicator 28 of the compartment and a mechanical and/or audible alarm, will be engaged. If more than one pill is to be taken at the same time, the visual alarm indicators 28 for more than one compartment will be simultaneously displayed on the LCD 18.

2. SetClk Mode

If the user presses the "MODE" button once during the Normal Mode, the device 10 will switch to the SetClk Mode and the LCD will display "SETCLK". This is the mode that the user utilizes to alter the current hour and minute of the device 10. To do this, the user simply presses the "HR" button to change the current hour, and the "MIN/SLOT" button to change the current minute. If no additional buttons are pressed by the user after a short period of time (such as 10 seconds) when in SetClk mode, the device 10 will automatically switch back to the Normal Mode.

3. Daily Dosage Mode

If the user presses the "MODE" button twice from the Normal Mode, the device 10 switches to the Daily Dosage mode and the LCD will display "DAILY DOSAGE," indicating that the device is now in this mode. This mode is used to program a drug schedule for the individual compartments 14 of the pillbox 10.

In the preferred embodiment of the present invention the dosage cycle is programmed by specifying the number of times to take a particular medication in a given day. Alternatively, the dosage cycle could be programmed by specifying the time interval between each pill-taking, or by other means.

When the device is switched to the "DAILY DOSAGE" mode, a visual indicator 28 of the first compartment (C1) is displayed on the LCD 18. In addition, the number of times to take the medication in C1 is displayed using the numeric display 26. Initially the device 10 is configured such that this number is "00", meaning that the compartment is not currently programmed. By pressing the "HR" button, the digits in the numeric display 26 will change from "00" to "01 " to "02", etc., depending on the dosage level. When the displayed number reaches a certain value it will automatically cycle back to "00" depending on the programmed sleep pattern of the user. To program another compartment, the user presses the "MIN/SLOT" button, and the visual indicator 28 will traverse to the next compartment, C2, and so forth. The dosage for that compartment is then displayed and the user can utilize the "HR" button to program the dosage level. Following a short period of inactivity, the device 10 will automatically return to Normal Mode.

4. Alarm Mode

If the user presses the "MODE" button three times from the Normal Mode the device 10 will enter the Alarm Mode, and the LCD 18 will display "ALARM", indicating that the device 10 has now entered this mode. In addition, the LCD numeric display 26 will display the start and end times in hours. The start time is the time that the user generally wakes up in the morning and the end time is the time that the user generally goes to bed at night. The programmed start and end times thus represent the programmed sleep pattern of the user. In the preferred embodiment, the device 10 only checks the dosage schedule after the start time and before the end time. The default start and end times are 8 and 23 respectively, meaning from 8:00 am to 11:00 pm.

By pressing the "HR" button 22 in this mode, the user can change the start time. By pressing the "MIN/SLOT" button 24, the user can change the end time. The start and end times are used to determine the time that the user should take a particular medication. Assuming the default settings (8 and 23), there are 16 hours in the user's day. If the user is supposed to take four dosages of a particular medication per day, then the pillbox computer will attempt to evenly divide the dosage within the 16 hour range. These times are then programmed into the computer and represent the alarm times for a particular medication. Subsequently, if the user changes the sleeping pattern by altering either the start or end time, the pillbox computer will dynamically recalculate the pill-taking interval and reprogram the pill-taking times.

The alarm itself, which, as noted above, may consist of a combination of visual, audible and/or mechanical means, is preferably not enabled until turned on by the user. The alarms can be toggled on/off by pressing down the "MODE" button when the device is in the Alarm Mode. A visible indicator of a bell will be displayed on the LCD 18 indicating to the user that the alarm(s) are enabled.

In addition to the modes described above, the preferred embodiment of the present invention also includes a low batter indicator on the LCD 18. Since the user depends upon the device 10 to meet a medication schedule, it is important to prevent the electronic pillbox 10 from losing power. To prevent this occurrence, the invention includes a low battery indicator on the LCD 18, which prompts the user to change the main battery 32 of the device. Should the main battery 32 fail, the preferred embodiment also includes a limited battery source that will maintain power to the device 10 for a short period of time so that the user can get a new main battery 32.

Turning now to the remaining drawing figures, FIGS. 5–13 are flow charts that describe in more detail the computer-implemented software instructions that control the electronic pillbox 10 of the present invention and which provide the ability to administer, schedule and dynamically reschedule a multiple drug therapy. The code-level detail of these software instructions, whether implemented as subroutines, modules, class hierarchies or functions, could be programmed by one of ordinary skill in the art having the teaching, description and diagrams contained in this application.

These software instructions are preferably part of the embedded microcomputer or microcontroller that resides on the PCB 30. The instructions could be stored in a memory that is integral to the microcontroller, or external, such as burned into an EPROM, EEPROM or Flash ROM device. Alternatively, these instructions could be converted into equivalent electronic circuitry for carrying out the same functions, such as could be programmed into an ASIC or FPGA device. In either case, the software instructions or equivalent circuitry provide the structure that support any means-plus-function claims appended to this application.

Figure 5:
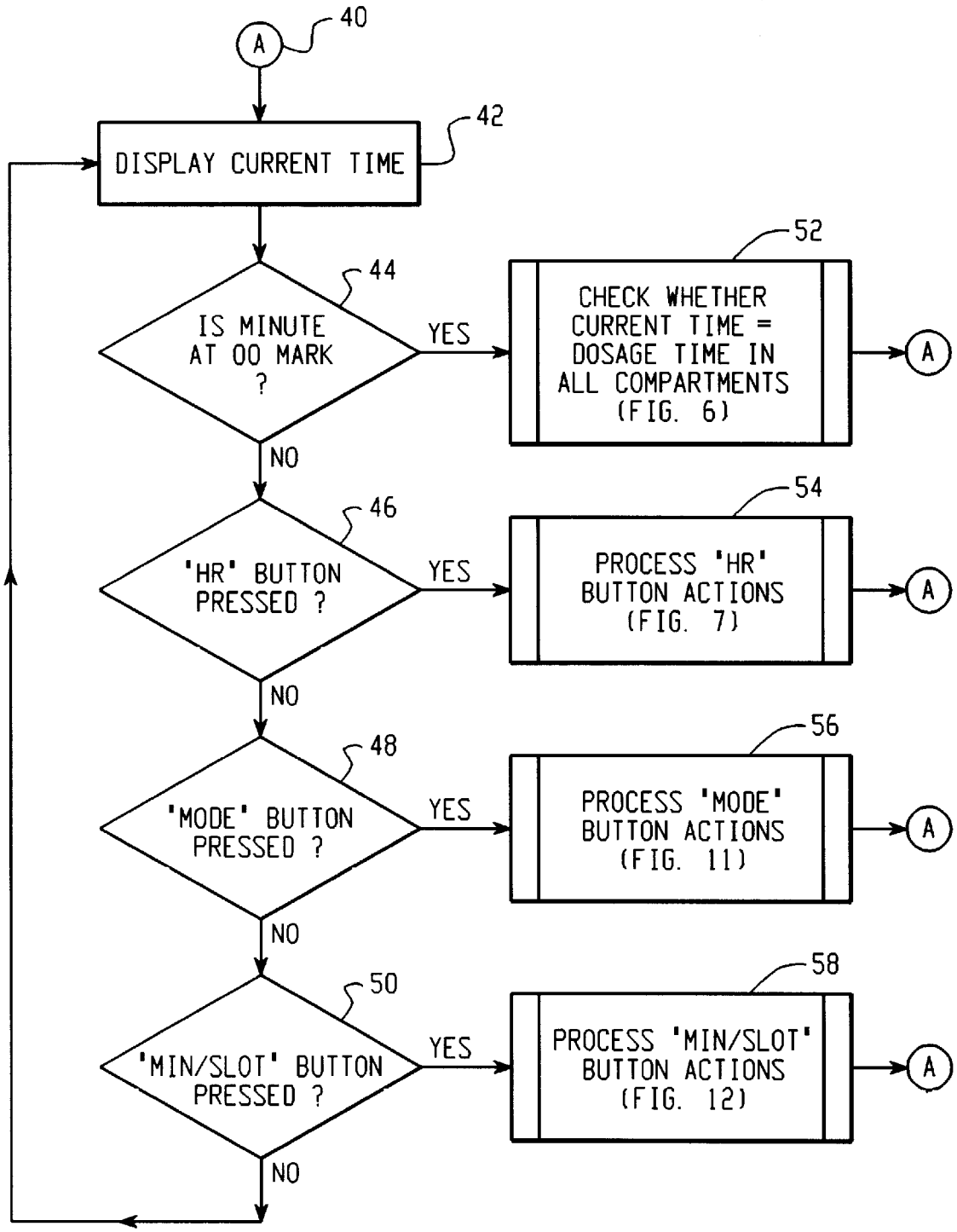
FIGS. 5–13 are flow charts that describe in diagrammatic form a preferred sequence of computer-implemented instructions that control the electronic computer included in the preferred pillbox of the present invention, and which provide the functionality to administer, schedule and dynamically reschedule a multiple-drug therapy.

FIG. 5 is a flow chart of the main event loop from which the other software modules and functions set forth on FIGS. 6–13 are called (or executed). The entry to the main event loop is at point A 40. At step 42 the current time is displayed on the numeric indicator 26 of the LCD 18. The device 10 then loops through a series of queries 44, 46, 48, 50, to determine if the minute portion of the current time is at "00" 44, if the "HR" button 22 has been pressed 46, if the "MODE" button 20 has been pressed 48, or if the "MIN/SLOT" button 24 has been pressed 50. If the answer to all of these queries is "NO", then the software system loops back to step 42, displays the current time, and continues to re-evaluate the queries. This process continues as long as power is supplied to the device 10.

If the minute portion of the current time is at "00", this indicates to the device 10 that it should check whether a particular medication is to be taken, since the device preferably checks for dosage times on the hour. At step 52, the device calls a subroutine (or module) that determines whether the current time is equal to the dosage time for each of the plurality of compartments 14. This modules is, described in more detail in FIG. 6. If the current time is not on the hour, then the device checks to see if one of the user interface buttons has been pressed. If the "HR" button 22 is pressed, then the system calls a module that processes the actions associated with this button 54. This module is described below in connection with FIG. 7. Likewise, if the "MODE" or "MIN/SLOT" buttons 20, 24 are pressed, then the system calls a module that processes the actions associated with these buttons. Step 56 processes the "MODE" button 20 actions, as set forth in FIG. 11, and step 58 processes the "MIN/SLOT" button 24 actions, as set forth in FIG. 12. After processing is completed by each of the modules 52, 54, 56, 58, control returns to point A 40, and the device 10 continues to loop through the main loop 42-44-46-48-50-42.

Figure 6:
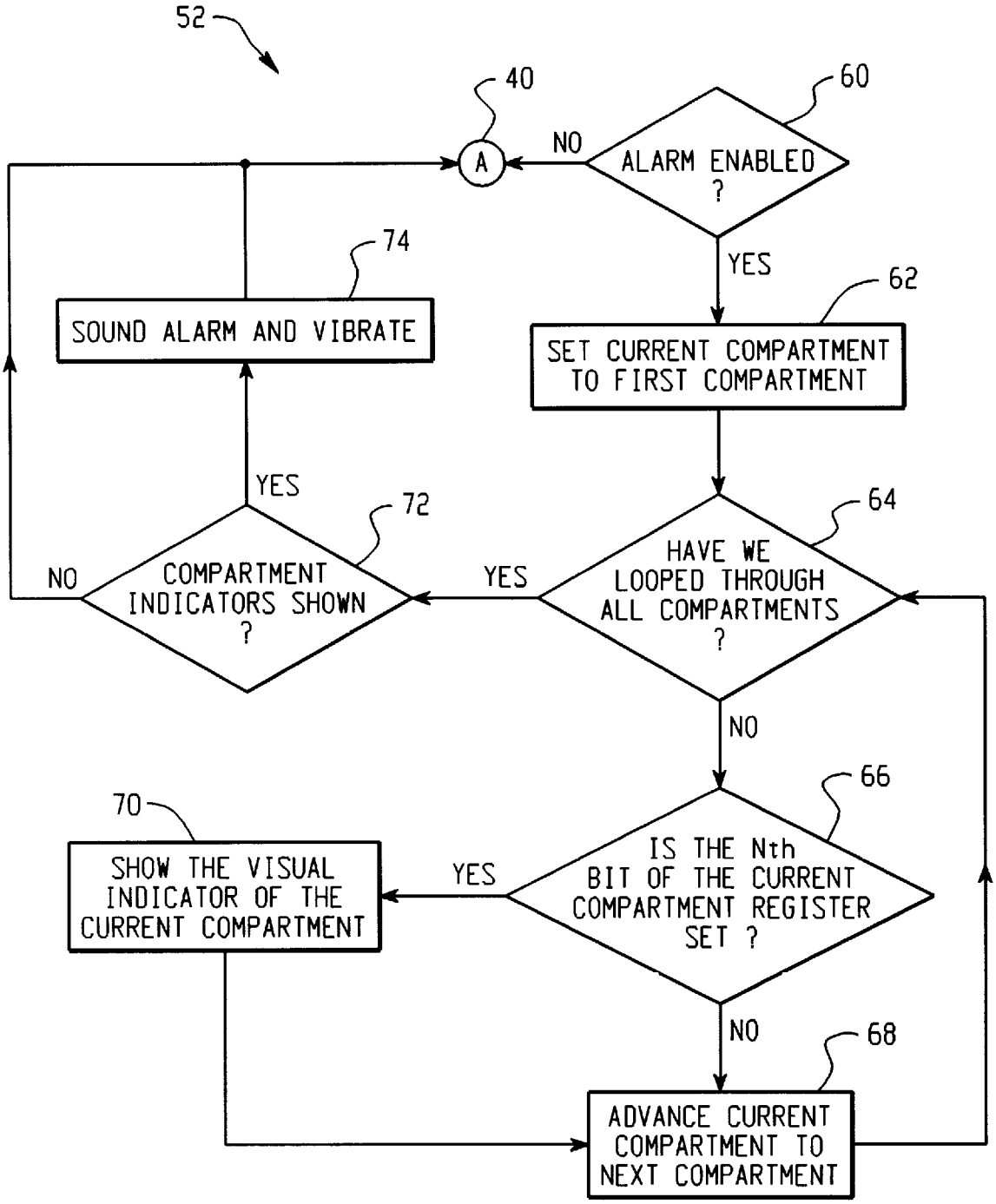

FIG. 6 sets forth a flow chart of the module 52 for determining whether the current time maintained by the pillbox 10 is equivalent to the dosage time in any of the plurality of compartments 14, such that an alarm(s) should be engaged. Processing begins at step 60, where the device determines if the alarm(s) have been enabled. If not, then processing in this loop ends and control returns to point A 40 of the main loop.

If the alarm is enabled, then control passes to step 62, where the device initializes to the first compartment (C1). At step 64, the computer determines if all compartments 14 have been analyzed. If not, then control passes to step 66, in which the "Nth" bit of the current compartment mask register is compared against the current time. The compartment mask registers are described in more detail below in connection with FIG. 13. In short, the mask registers hold a sequence of bits that correspond to certain hours of the day, and if a bit is set that corresponds to a particular hour, then the device should sound the alarm(s) at that time. For example, if the seventh bit of the current compartment mask register is set (i.e. is non-zero), and the current time is 7:00 a.m., then the outcome of step 66 will be positive. If step 66 is positive, then control passes to step 70, in which the visual indicator 28 of the particular compartment under review is enabled. Following this step, or if the outcome of step 66 was negative, control loops back to step 64, and the device 10 determines if all compartments 14 have been checked. If not, processing continues through 66, 68 and 70.

If all compartments 14 have been reviewed, than control passes to step 72, which determines if certain compartment visual indicators 28 have been activated from step 70. If any compartment visual indicator 28 has been activated, then a common alarm will either sound or mechanically vibrate, or both 74. However, it is possible to program the device to have different sounding alarms (as opposed to a common alarm indicator) or different feeling mechanical vibrations for each compartment 14, such that the user knows what medication to administer from the visual and audible or mechanical indication. Following step 74, or if no compartment visual indicators 28 are activated, control passes back to point A 40 of the main loop.

Figure 7:
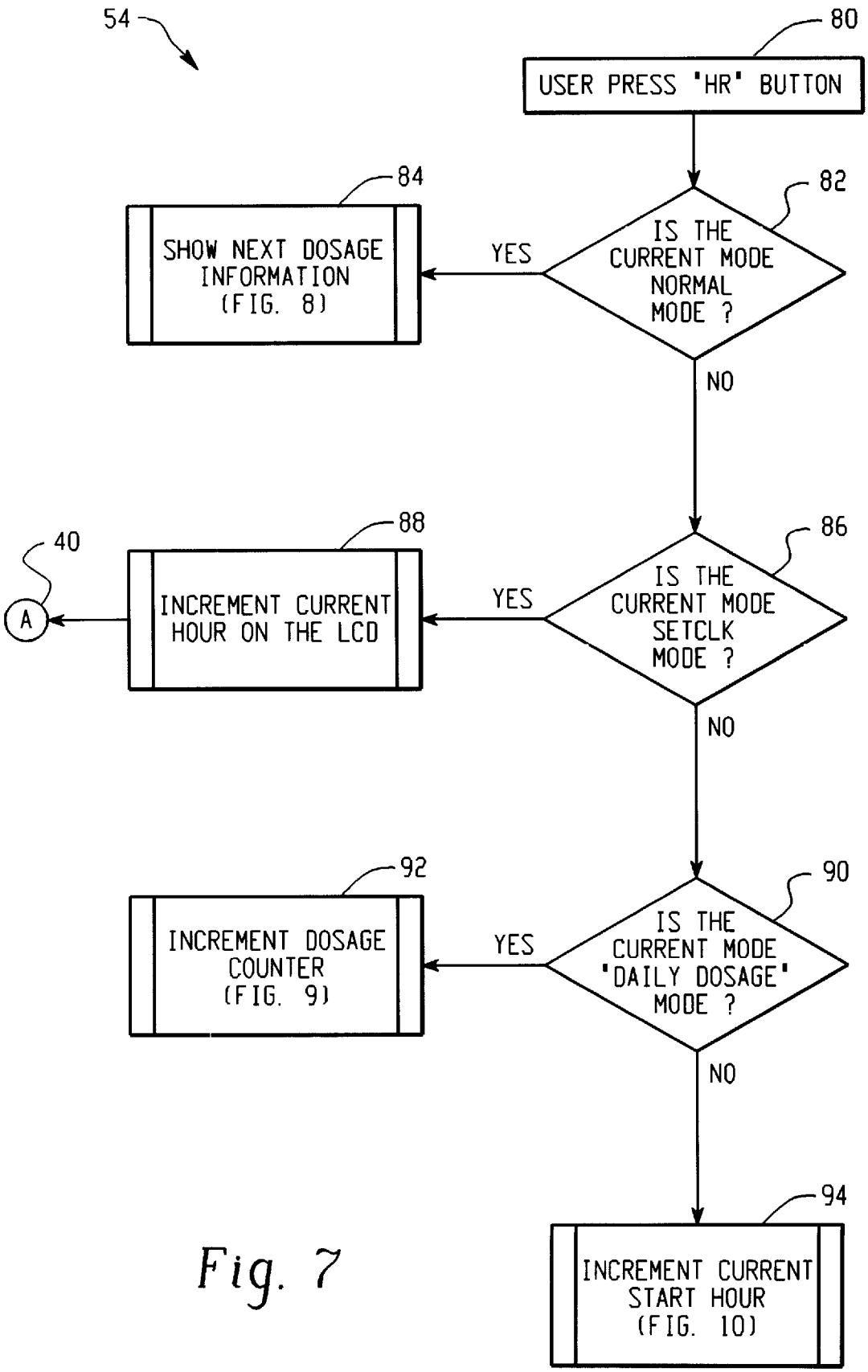

Turning now to FIG. 7, a flow chart is set forth that shows the module for providing the functionality associated with the user pressing the "HR" button 22 on the user interface 12. Processing begins at step 80. If the pillbox 10 is in the Normal Mode when the "HR" button 22 is pressed, then at step 82, processing is passed to step 84, which displays the next dosage information as described in FIG. 8. If the current mode is the SetClk Mode when the "HR" button 22 is pressed, then at step 85, processing is transferred to step 88. At this step 88, the current hour setting of the clock on the LCD 18 is incremented, and control reverts back to point A 40 of the main processing loop. If the current mode is the Daily Dosage Mode when the "HR" button 22 is pressed, then at step 90 processing is passed to step 92, which increments the dosage counter as described in FIG. 9. If queries 82, 86 and 90 are all negative, then the electronic pillbox 10 must be in the Alarm Mode. In this case processing passes to step 94, which increments the start hour as described in FIG. 10.

Figure 8:
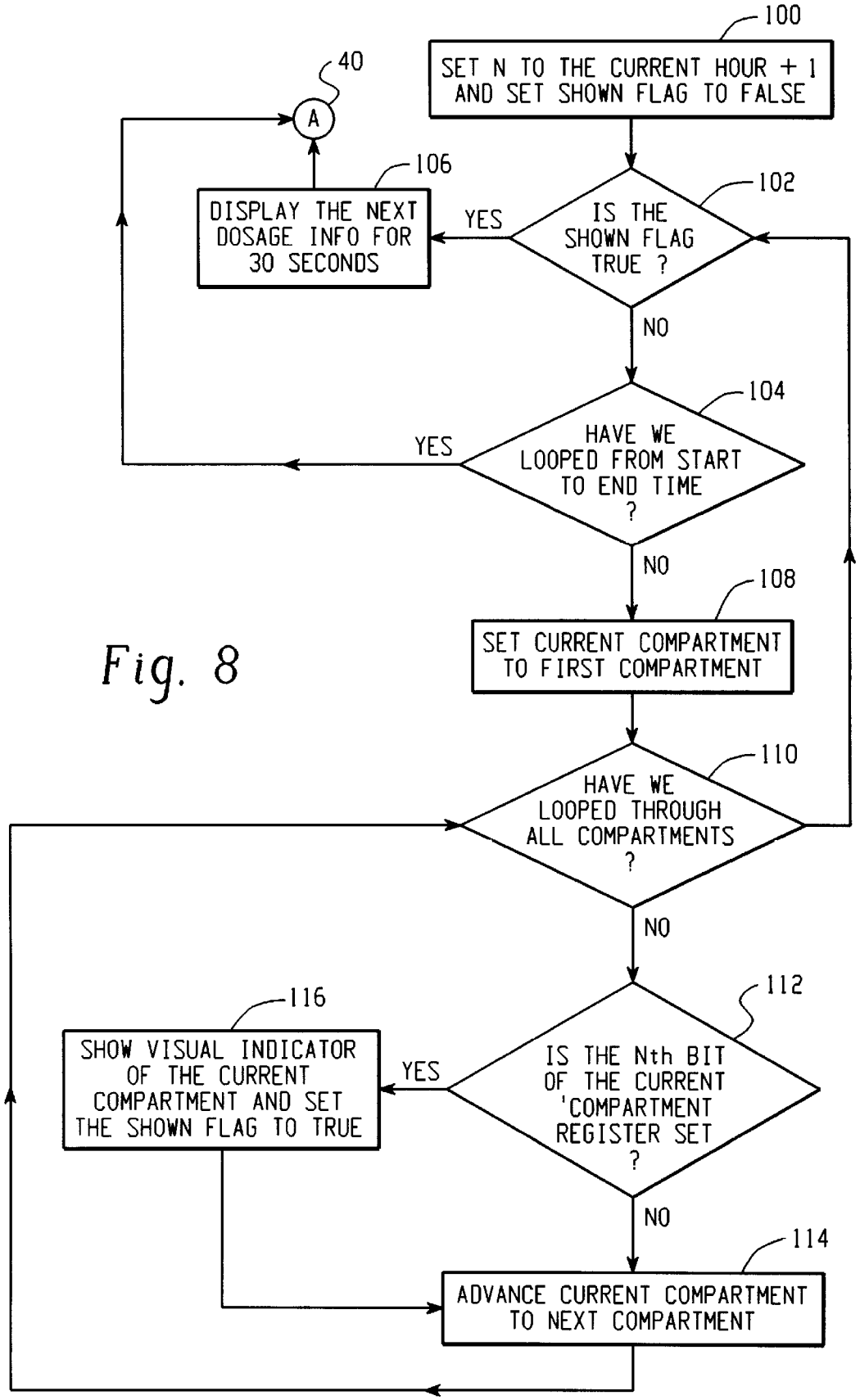

FIG. 8 is a flow chart of the function for displaying dosage information to the user. At step 100 the variable N is set to the current hour incremented by one hour and a variable termed "$shown_{13}$ flag" is set false. At step 102 the software determines if the shown_flag variable is set true. If so, the dosage information is displayed at step 106 for 30 seconds, and control reverts to point A 40 of the main event loop. If the shown_flag variable is false, than control passes to step 104, which determines whether the system has traversed from the start time to the end time. If so, then control passes to point A 40 of the main event loop. If not, then control passes to step 108, and the current compartment is set to be the first compartment.

At step 110, the software module determines whether all compartments 14 have been analyzed. If so, then N is incremented by one hour and control passes back to step 102. If not, then control passes to step 112. At step 112, the software determines if the Nth bit corresponding to variable N of the current compartment mask register is set to be non-zero, indicating the next dosage time. If the Nth bit is set, then at step 116 the visual indicator 28 for the current compartment is displayed on the LCD 18, and the shown_flag variable is set true. If the Nth bit is not set, or after step 116, control passes to step 1145 which increments the current compartment to the next compartment. The software then loops back to step 110 to determine if all compartments have been analyzed. After all the compartments have been analyzed for the next dosage time, control passes to step 102, and since the shown_flag variable will now be set to true, control passes to step 106, and the next dosage information is displayed on the numeric indicator 26.

Figure 9:
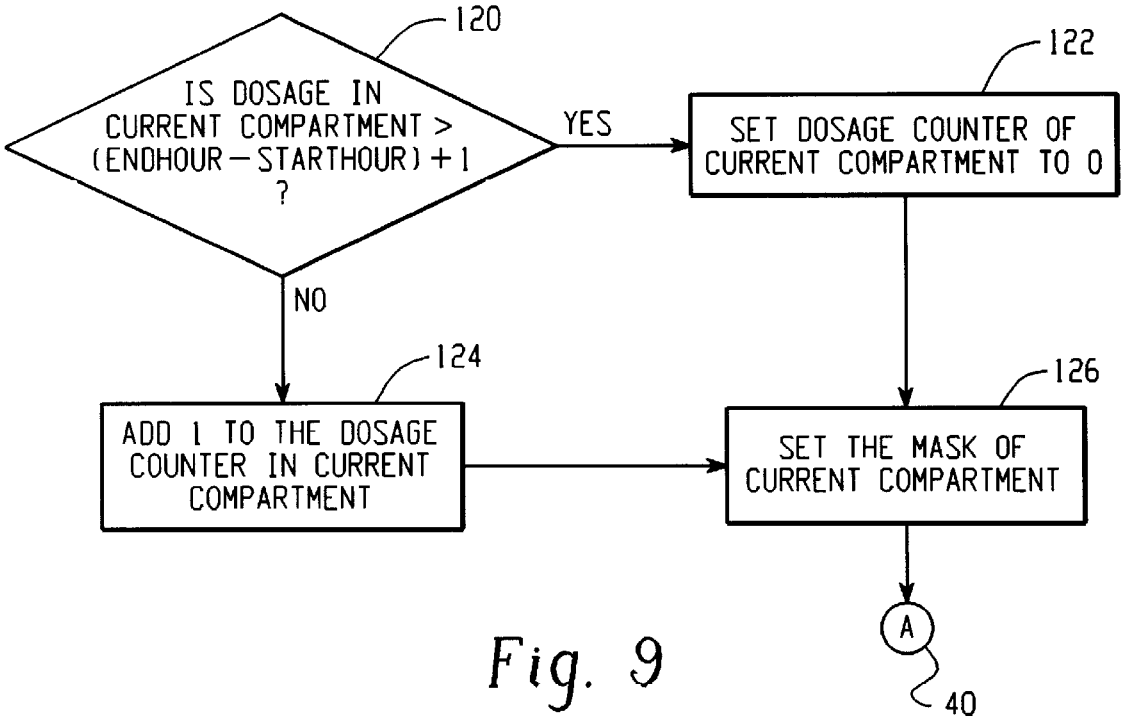

FIG. 9 is a flow chart of the function for incrementing the dosage counter 92. At step 120, the software first checks whether the dosage count in the current compartment is greater than End_Hour minus Start_Hour plus one, indicating a dosage level that is greater than the number of hours available in the user's day. End_Hour is the time that the user goes to bed, measured in an incremental number of hours, and Start_Hour is the time that the user wakes up, also measured in an incremental number of hours. If the outcome of step 120 is positive, then at step 122 the dosage counter is set to "0". If the outcome of step 120 is negative, than at step 124 the dosage counter is incremented. Following steps 122 or 124, control passes to step 126, which sets the compartment mask register of the current compartment. Control then reverts to point A 40 of the main event loop.

Figure 10:
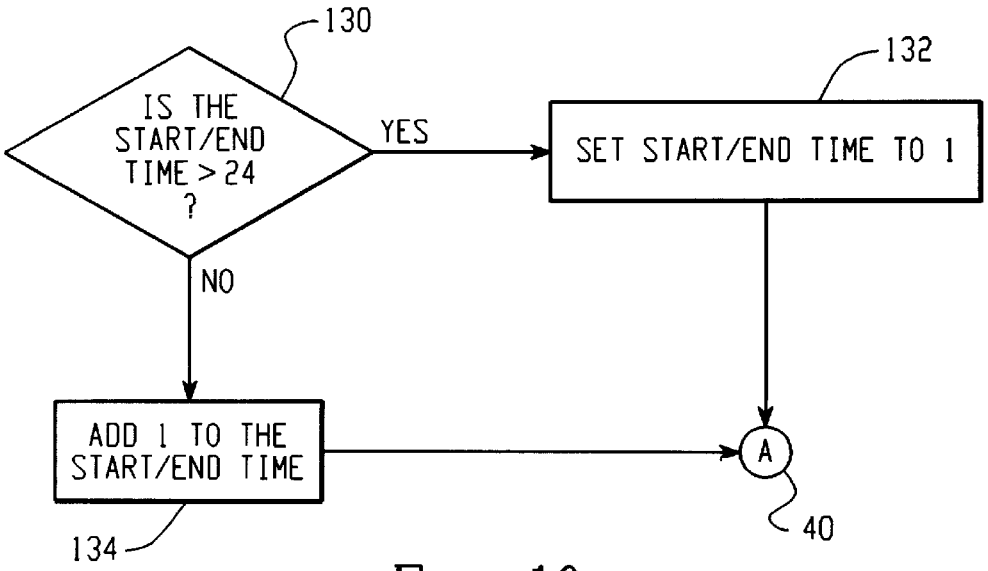

FIG. 10 is a flow chart of the function for incrementing the start time 94 or end time 166. At step 130, the software first determines whether the start or end time is greater than 24. If so, then the start or end time is set to be one at step 132. If not, then the start or end time is incremented at step 134. In either case control reverts to point A 40 of the main event loop.

Figure 11:
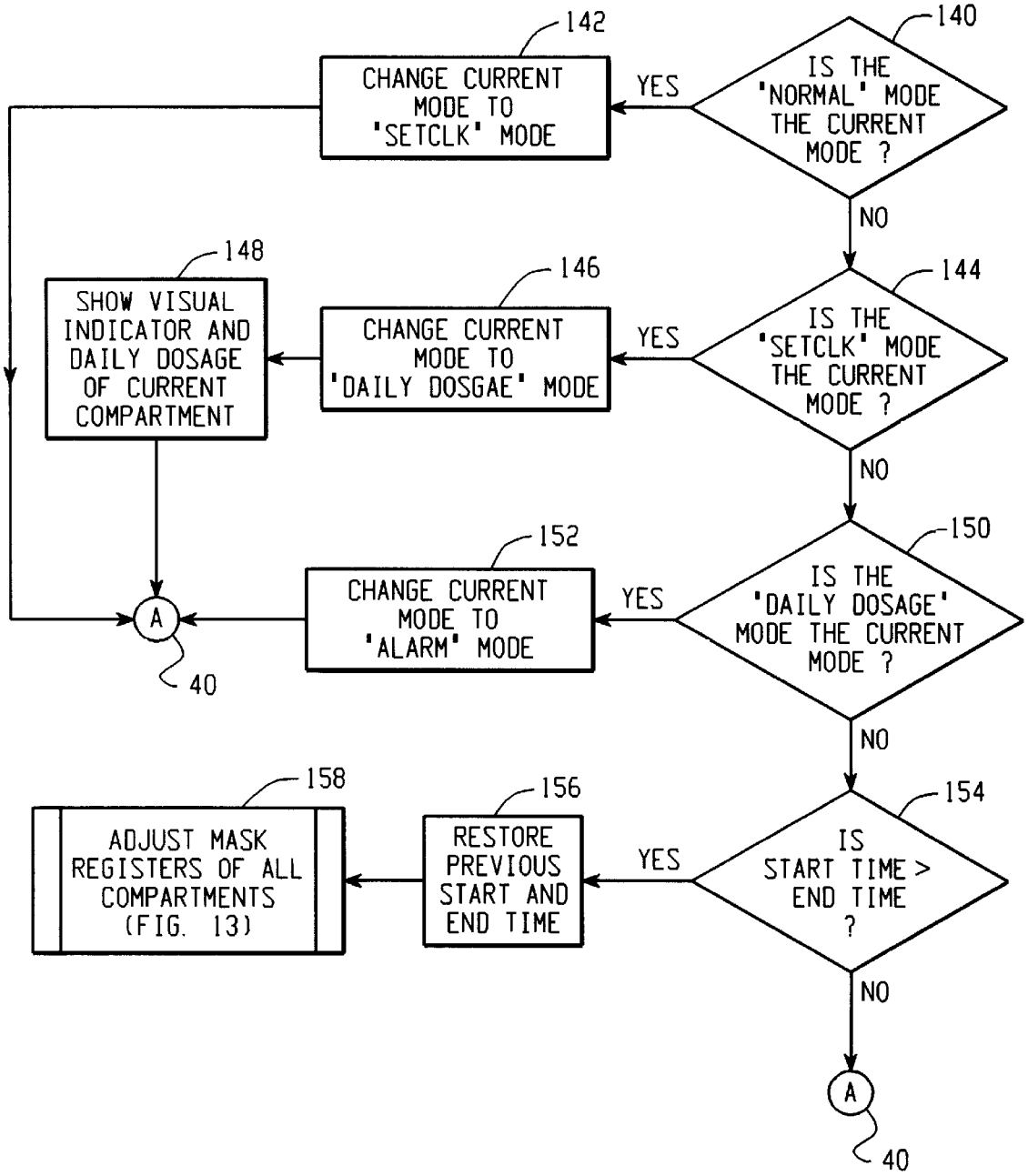

Turning now to FIG. 11, a flow chart of the module for providing the functionality associated with the user pressing the "MODE" button 20 is set forth This module consists of a series of queries 140, 144, 150, 154, and associated actions. If the outcome of these queries is negative, then control passes back to point A 40.

At step 140, the software determines if the current mode is the Normal Mode. If so, then at step 142 the current mode is changed to the SetClk Mode. At step 144, the software determines if the current mode is the SetClk Mode. If so, then the current mode is changed to the Daily Dosage Mode at step 146, and at step 148 the visual indicator 28 associated with the current compartment and its dosage level is displayed on the LCD 18. At step 150, the software determines if the current mode is the Daily Dosage Mode. If so, then the current mode is changed to the Alarm Mode. After steps 142, 148 and 152, control passes back to point A 40 of the main event loop.

At step 154, the software determines if the start time is greater than the end time, which in the preferred embodiment of the invention is an invalid condition. If so, then at step 156 the previous start and end times are restored, and at step 158 a function is called that adjusts the mask registers of all the compartments, as described in FIG. 13.

Figure 12:
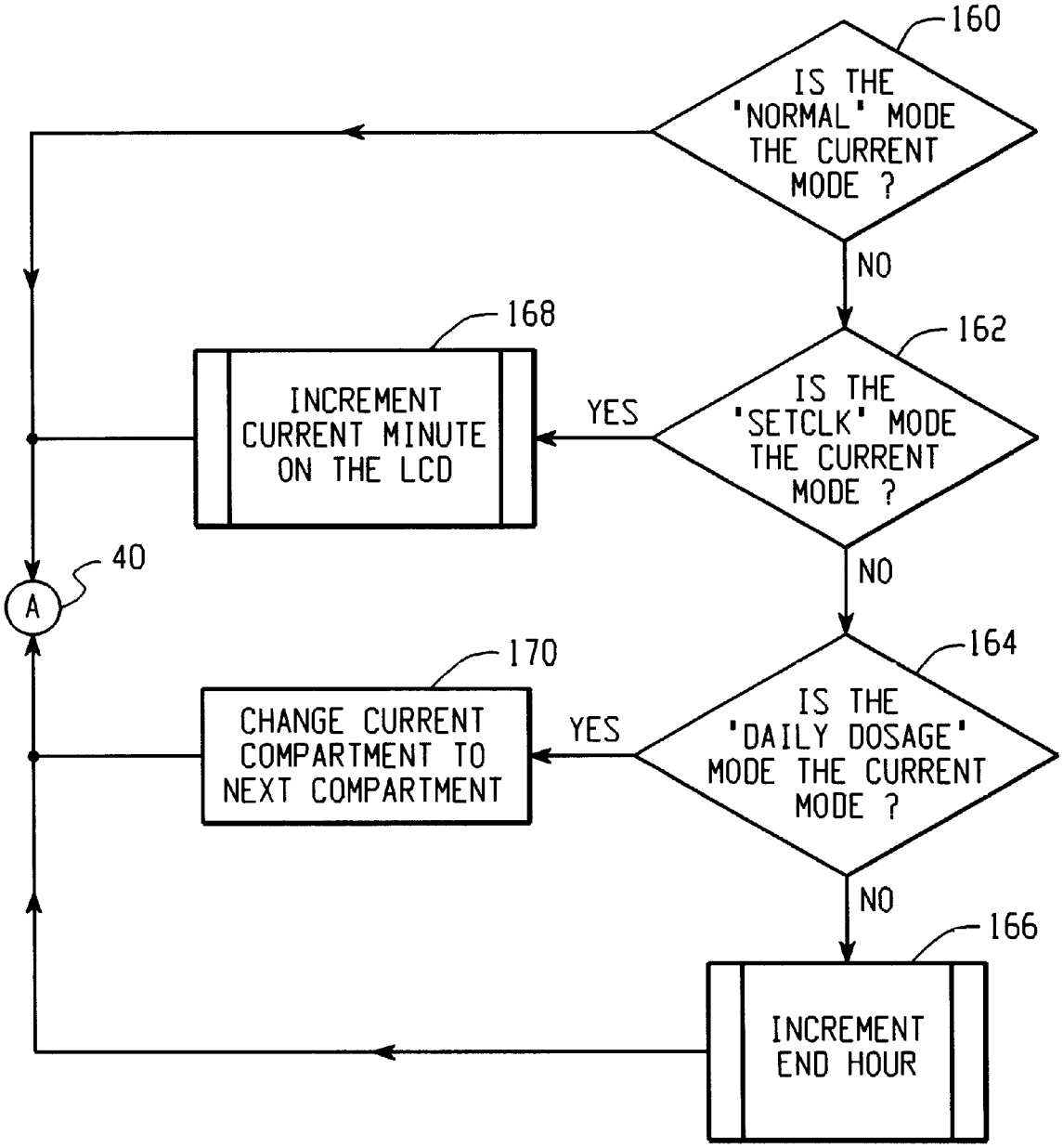

FIG. 12 is a flow chart of ache module for providing the functionality associated with the user pressing the "MIN/SLOT" button 24 on the user interface. At step 160, the system determines whether it is in Normal Mode. If so, then processing reverts to point A 40 of the main event loop. If not, then at step 162, the system checks whether it is in SetClk Mode when the "MIN/SLOT" button is pressed. If so, then at step 168 the current minute displayed on the LCD is incremented, and control passes back to the main loop. If the system is not in SetClk Mode, then at step 164 the software determines if it is in the Daily Dosage Mode. If so, then control passes to step 120, which changes the current compartment to the next compartment. If tests 160, 162 and 164 all fail, then the device 10 must be in Alarm mode. Therefore, at step 166 the end hour is incremented, and control reverts back to the main event loop.

Figure 13A:
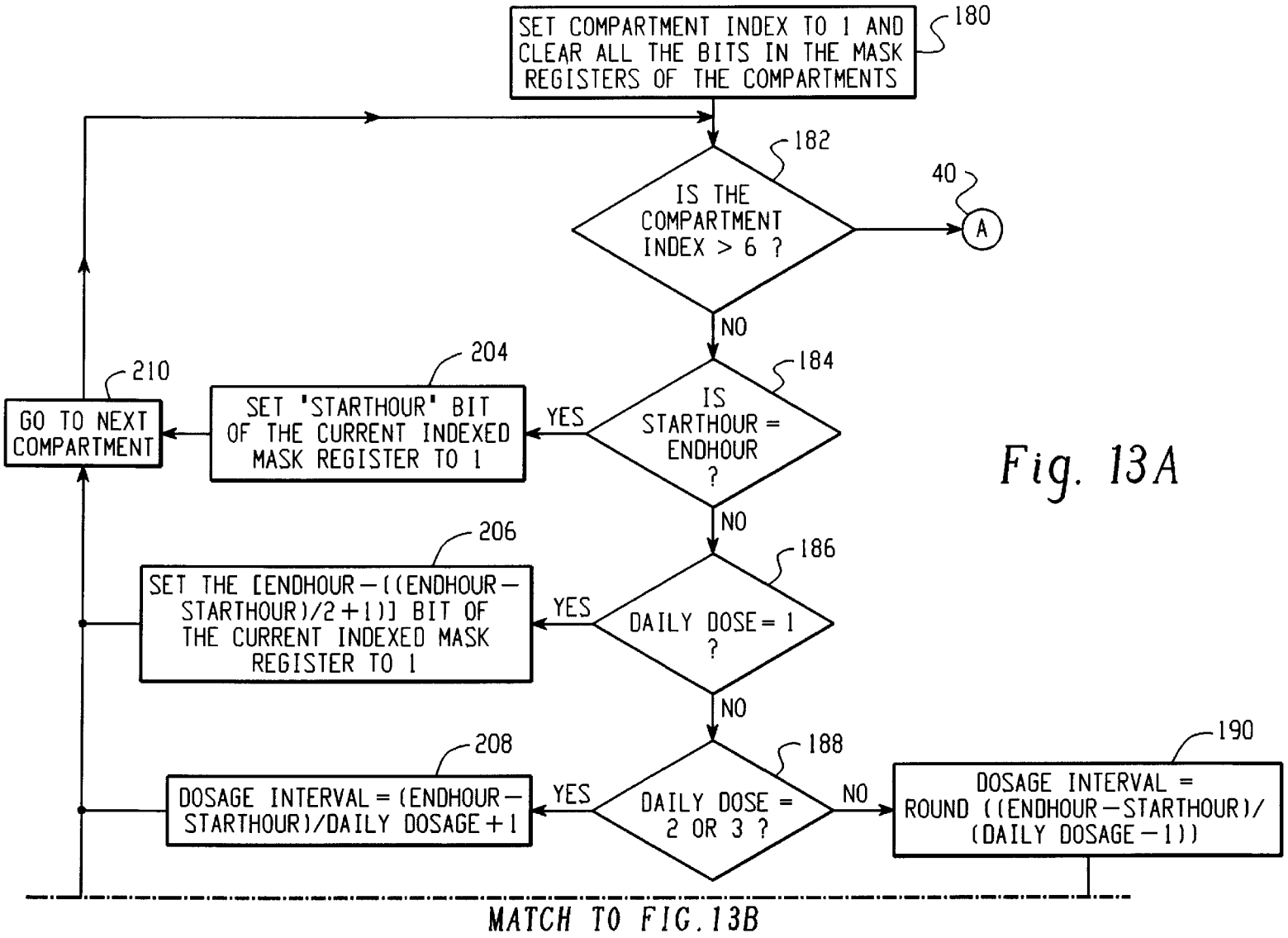
Figure 13B:
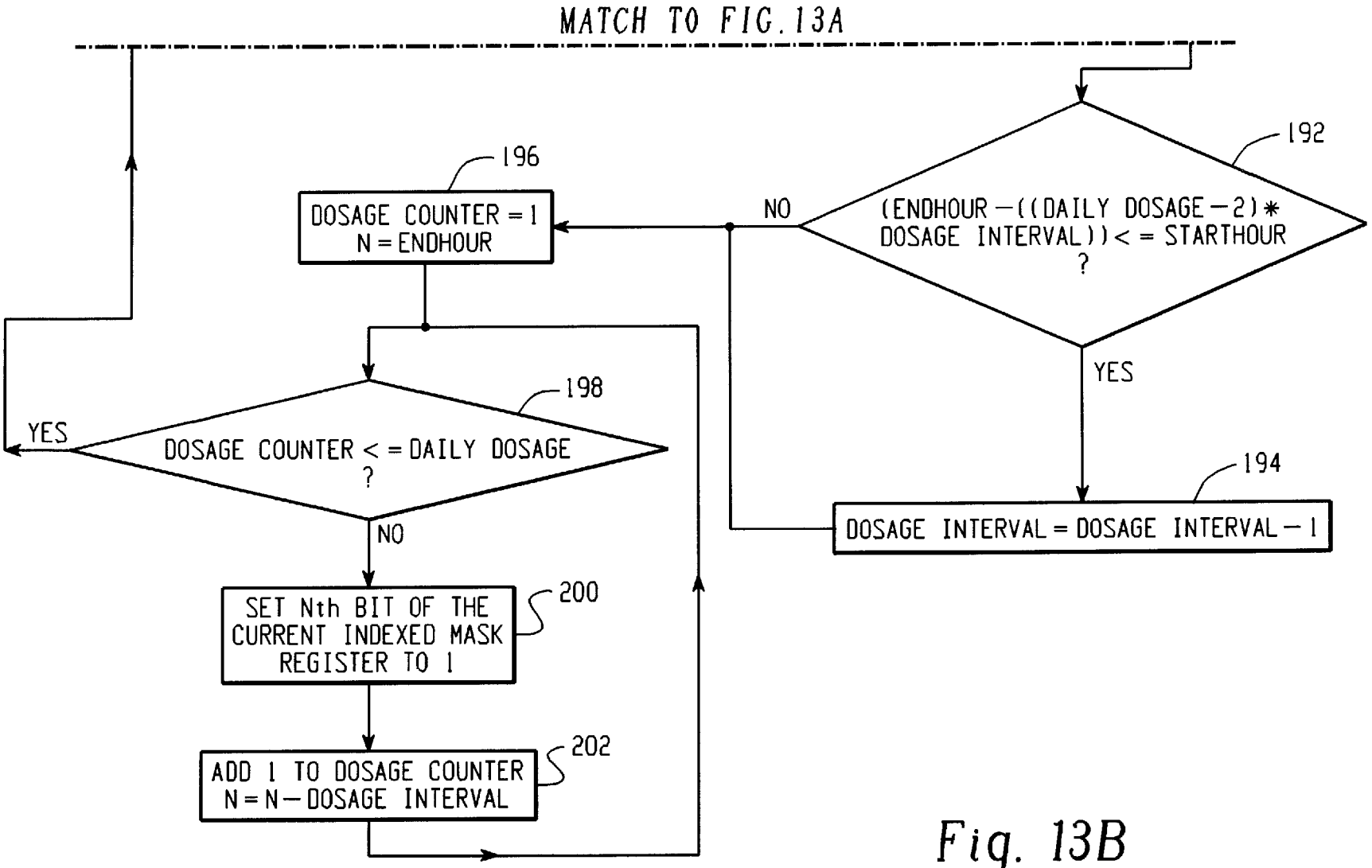

Turning finally to FIG. 13, a flow chart is set forth that describes the function of adjusting the mask registers of all the compartments 158. There are a plurality of compartment mask registers programmed into the software of the present invention that controls the electronic pillbox 10, one register for each compartment 14. Thus, in the preferred embodiment of the invention set forth on FIGS. 1–4, there are six compartment mask registers. Each compartment mask register is preferably composed of three bytes of data, and each bit in these three bytes (24 bits) corresponds to one hour in the day—24 bits, 24 hours in the day.

The layout of an example compartment mask register could be as follows:

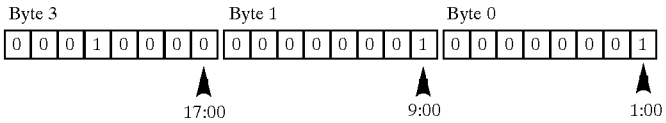

In this example compartment mask register the medication is set to be taken at 1:00, 9:00, and 21:00. When a particular compartment does not contain medication or has not been scheduled, then all of the bits in the mask register are set to zero. This is the initial setting when the user first operates the electronic pillbox 10. When a dosage is scheduled for a certain time, as in step 126 of FIG. 9, the bit that corresponds to that time in the mask register is set to "1 " . As described above, knowing the dosage level, start time, and end time, the electronic pillbox 10 of the present invention is able to automatically calculate the time intervals between dosages and automatically sets the appropriate bits in the compartment mask registers. If the user then subsequently alters the start or end times, the pillbox automatically recalculates the time intervals and sets the appropriate bits in the compartment mask register.

Turning back to FIG. 13, the function is set forth for adjusting all of the mask registers when the start time is programmed to be greater than the end time, which is not a valid condition in the preferred embodiment of the invention. Beginning at step 180, a compartment index value is set to "1", and all of the bits in the compartment mask registers are cleared, i.e. set to zero. At step 182, the system checks if the compartment index is greater than six, signifying that all six compartments in the preferred embodiment have been adjusted. If so, then control passes back to point A 40 of the main event loop). If not, then the remainder of the function set forth in FIG. 13 adjusts the mask registers of the current compartment as specified by the compartment index value.

Steps 184 through 208 set the compartment mask registers for the current compartment. Following these steps, the system increments the compartment index to the next compartment at step 210, and the sequence of steps 184 through 208 continues until the condition in step 182 is met.

Starting at step 184, the software checks whether the start hour is equal to the end hour. If so, then the start hour bit of the current index mask register is set to "1 " at step 204, and control passes to step 210 to increment to the next compartment. In this situation no medication is scheduled for this particular compartment. Assuming the start and end hours are not equal, control passes to step 186, in which the software determines if the programmed daily dosage is equal to one dose. If so, then at step 206, the system computes the midpoint time between the starting and ending hours, and sets the appropriate compartment mask register bit to "1 ".

If the daily dosage value is not one, then control passes to step 188, in which the software then determines if the daily dosage value is either two or three. If so, then control passes to step 208, in which the dosage interval is computed. This dosage interval is then used to set the appropriate compartment mask register bits. If the daily dosage is not three or less, then control passes to steps 190–202, which set the compartment mask registers for dosage levels greater than three.

At step 190 the dosage interval is computed. This value is rounded to the nearest hour. At step 192, the software determines whether the dosage value can fit within the number of hours between start and end times. If so, then control passes to step 196. If not, then the dosage interval is reduced by one, and control passes to step 196. Finally, steps 196 through 202 set the appropriate component mask register bits based on the computed dosage interval. Control then passes back to step 210, the compartment index is incremented, and the next compartment mask register is adjusted. This process continues until step 210 increments the compartment index to greater than the number of compartments, which is six in the preferred embodiment, resulting in a positive result at step 182. At this point all of the compartment mask registers have been adjusted.

Having described in detail the preferred embodiment of the present invention, including its preferred modes of operation, it is to be understood that this operation could be carried out with different elements and steps. This preferred embodiment is presented only by way of example and is not meant to limit the scope of the present invention which is defined by the following claims.

What is claimed:

1. A portable electronic pillbox, comprising:

a plurality of medication compartments;

a user-interface for displaying information to a user of the pillbox and for receiving information from the user, the user information including a start time and a stop time indicating the sleeping pattern of the user, and a dosage amount for each medication in the plurality of medication compartments; and an electronic computer for automatically calculating a dosage schedule for each medication compartment based upon the sleeping pattern of the user and the dosage amount for the particular medication.

2. The portable electronic pillbox of claim 1, further comprising:

a power source including a main battery for supplying power to the pillbox, and a backup battery for supplying a limited amount of power to the pillbox when the main battery fails.

3. The portable electronic pillbox of claim 1, further comprising:

a plurality of visual alarm indicators.

4. The portable electronic pillbox of claim 3, wherein each compartment has an associated visual alarm indicator.

5. The portable electronic pillbox of claim 1, further comprising:

an audible alarm indicator.

6. The portable electronic pillbox of claim 5, wherein the audible alarm indicator generates a distinct sound for each compartment.

7. The portable electronic pillbox of claim 1, further comprising:

a mechanical alarm indicator.

8. The portable electronic pillbox of claim 1, wherein each medication compartment includes a separate lid.

9. The portable electronic pillbox of claim 1, wherein the pillbox is made of transparent plastic.

10. The portable electronic pillbox of claim 1, wherein the user interface includes an LCD for displaying information to the user, and a plurality of user interface buttons.

11. The portable electronic pillbox of claim 10, wherein the LCD display includes a numeric timer, a plurality of visual alarm indicators, and a plurality of navigational messages.

12. The portable electronic pillbox of claim 11, wherein the LCD display includes a visual alarm indicator for each compartment.

13. The portable electronic pillbox of claim 10, wherein the LCD display further includes a low battery indicator.

14. The portable electronic pillbox of claim 10, wherein the plurality of user interface buttons include at least 2 buttons for controlling the operation of the electronic computer.

15. The portable electronic pillbox of claim 14, wherein the plurality of user interface buttons are used to input the user information regarding the dosage amount for each medication and the user's sleeping pattern.

16. The portable electronic pillbox of claim 10, wherein the electronic computer is programmed to operate in a plurality of different functional modes.

17. The portable electronic pillbox of claim 16, wherein one of the user interface buttons is for switching the pillbox between the plurality of different functional modes.

18. The portable electronic pillbox of claim 16, wherein the plurality of modes include a normal mode, a set clock mode, a daily dosage mode, and an alarm mode.

19. The portable electronic pillbox of claim 1, wherein the electronic computer automatically recalculates the dosage schedules for each medication compartment if the user alters the information regarding the user's sleeping pattern.

20. A portable electronic pillbox, comprising:

a plurality of medication compartments;

a visual alarm indicator for each compartment; and an electronic computer for automatically calculating a dosage schedule for each medication compartment based upon information entered into the computer by a user of the pillbox, including the user's sleeping pattern and the dosage amount for the medication, and for enabling the appropriate visual alarm indicator when a particular medication is scheduled for delivery.

21. A compact electronic pillbox, comprising:

a plastic housing partitioned into a plurality of compartments, each compartment having a separate lid;

an electronic user interface and control device located at the center of the plastic housing, including an LCD, a plurality of user input buttons, a microcomputer, and a battery; and a control program executed by the electronic user interface and control device for receiving data indicating the sleeping pattern of a user of the pillbox and the dosage amount for each compartment, and for calculating a dosage schedule for each compartment based on the sleeping pattern of the user and the dosage amount for the particular compartment.

22. A portable electronic pillbox, comprising:

means for storing a plurality of medications;

means for displaying information to a user of the pillbox regarding a medication schedule, and for receiving information from the user, including information regarding the sleeping pattern of the user and the dosage amount for each of the medications contained in the means for storing; and means for calculating the medication schedule for each of the medications contained in the means for storing based on the information from the user regarding the dosage amount for each medication and the user's sleeping pattern.

23. The portable electronic pillbox of claim 22, comprising:

means for automatically recalculating the medication schedule based on a change in the user information.

24. A portable electronic pillbox, comprising:

a plurality of medication compartments;

a visual alarm indicator for each compartment;

a mechanical or audible alarm; and a microcomputer for scheduling dosage times for each medication compartment based upon a user's sleeping pattern and a dosage amount for each medication, and for enabling the visual and mechanical or audible alarms when a particular medication is scheduled for administration.

25. A method of scheduling dosage times for a multiple-drug therapy, comprising the steps of:

providing a portable electronic pillbox having a plurality of medication compartments, a visual indicator for each compartment, and an electronic computer coupled to the visual indicators;

inputting user information to the electronic computer, including a start time and a stop time that define the user's sleeping pattern, and a dosage amount for each drug contained within the plurality of medication compartments;

calculating a dosage schedule for each drug based upon the user's sleeping pattern and the dosage amount for the particular drug; and enabling the visual indicators for each compartment in response to the dosage schedule indicating that a particular drug should be taken.

* * * * *